US007175480B2

(12) United States Patent
Yamashita

(10) Patent No.: US 7,175,480 B2
(45) Date of Patent: Feb. 13, 2007

(54) CONNECTOR AND A TERMINAL FITTING

(75) Inventor: Kazunori Yamashita, Yokkaichi (JP)

(73) Assignee: Sumitomo Wiring Systems, Ltd. (JP)

( * ) Notice: Subject to any disclaimer, the term of this patent is extended or adjusted under 35 U.S.C. 154(b) by 0 days.

(21) Appl. No.: 10/858,643

(22) Filed: Jun. 2, 2004

(65) Prior Publication Data

US 2004/0219841 A1 Nov. 4, 2004

(30) Foreign Application Priority Data

Jun. 2, 2003 (JP) ..... 2003-156713

(51) Int. Cl.
*H01R 13/40* (2006.01)
*H01R 9/16* (2006.01)

(52) U.S. Cl. ..... 439/733.1; 439/869

(58) Field of Classification Search ..... 439/733.1, 439/869, 862, 444, 79, 741, 743
See application file for complete search history.

(56) References Cited

U.S. PATENT DOCUMENTS 5,158,479 A * 10/1992 Mouissie ..... 439/589
5,286,218 A * 2/1994 Sakurai et al. ..... 439/444
5,362,256 A * 11/1994 Hashiguchi ..... 439/660
5,489,221 A * 2/1996 Fujiura et al. ..... 439/733.1
5,885,113 A * 3/1999 Bricaud ..... 439/733.1
5,984,735 A * 11/1999 Daoud ..... 439/733.1
6,048,232 A * 4/2000 Chen ..... 439/733.1
6,093,062 A * 7/2000 Chiu ..... 439/733.1
6,152,782 A * 11/2000 Volkert et al. ..... 439/733.1
6,454,575 B1 * 9/2002 Jones et al. ..... 439/79

FOREIGN PATENT DOCUMENTS

DE 3441416 A1 5/1986
DE G 92 13 682.6 4/1993
DE 691 16 283 T2 9/1996
DE 691 22 301 T2 4/1997
DE 696 13 501 T2 4/2002
DE 103 29 681 A1 2/2004
JP 8-37050 2/1996

* cited by examiner

*Primary Examiner*—Hien Vu
(74) *Attorney, Agent, or Firm*—Gerald E. Hespos; Anthony J. Casella

(57) ABSTRACT

A terminal fitting (20) has close-contact portions (24) that frictionally engage inner walls (11*a*) of a press-in hole (11), biting projections (25) behind the close-contact portions (24) for biting in the inner walls (11*a*) of the press-in hole (11) and recesses (26) behind the biting projections (25). The close-contact portions (24) are held in sliding contact with the inner walls (11*a*) at an initial stage of the pressing operation. Thus, a resistance is smaller as compared to a case where projections are moved while biting in the inner walls (11*a*).

4 Claims, 14 Drawing Sheets

CONNECTOR AND A TERMINAL FITTING

BACKGROUND OF THE INVENTION

1. Field of the Invention

The invention relates to a connector in which a terminal fitting is pressed into a housing, and to the terminal fitting.

2. Description of the Related Art

Japanese Unexamined Patent Publication No. H08-37050 and FIGS. 12 to 14 herein show a circuit board connector. With reference to FIGS. 12 to 14, the connector has a synthetic resin housing 100 and a press-in hole 101 penetrates the housing 100. A long narrow terminal fitting 102 is pressed into this press-in hole 101, and lateral edges 103 of the terminal fitting 102 forcibly widen the inner wall of the press-in hole 101. The inner wall of the press-in hole 101 then presses the lateral edges 103 of the terminal fitting 102 due to the restoring force of the resin. Thus, the terminal fitting 102 is locked so as not to come out due to a frictional resistance resulting from this pressing force.

The lateral edges 103 of the terminal fitting 102 are straight and parallel with a pressing direction. Thus, the terminal fitting 102 is locked only by the frictional resistance between the inner wall of the press-in hole 101 and the lateral edges 103. As a result, an external force on the terminal fitting 102 in a direction opposite the pressing direction can displace or withdraw the terminal fitting 102.

The present invention was developed in view of the above problem and an object thereof is to securely lock a terminal fitting so as not to come out.

SUMMARY OF THE INVENTION

The invention relates to a terminal fitting that is to be pressed into a press-in hole in a housing. The terminal fitting has at least one lateral edge with at least one close-contact portion adapted to forcibly widen an inner wall of the press-in hole as the terminal fitting is pressed into the press-in hole. At least one biting projection is located behind the close-contact portion with respect to the pressing direction and is configured to bite in the inner wall of the press-in hole as the terminal fitting is pressed into the press-in hole.

The close-contact portion preferably is a substantially straight close-contact portion arranged substantially parallel with a pressing direction.

The lateral edge of the terminal fitting preferably further comprises at least one recess substantially continuous with the rear end of the biting projection and a push-in portion substantially continuous with the rear end of the recess.

A portion of the inner wall of the press-in hole that has entered the recess after the passage of the biting projection may be pushed by the push-in portion and deformed while staying in the recess in the pressing process.

The biting projection preferably has a projecting distance along a widthwise direction that is substantially larger than a projecting distance of the close-contact portion.

The invention also relates to a connector with at least one of the above-described terminal fittings and a housing with at least one press-in hole for receiving the terminal fitting.

A force may act in withdrawing direction on the terminal fitting pressed into the housing. However, the terminal fitting is securely locked by frictional resistance between the close-contact portion and the inner wall of the press-in hole and the biting of the biting portion in the inner wall of the press-in hole. The straight close-contact portion is substantially parallel with the pressing direction and is held in sliding contact with the inner wall of the press-in hole at an initial stage of the pressing operation. Thus, a smaller resistance is created during the pressing operation as compared to a case where a projected portion is moved while biting in the inner wall of the press-in hole.

The lateral edge of the terminal fitting further comprises a recess continuous with the rear end of the biting portion, and a push-in portion continuous with the rear end of the recess. A portion of the inner wall of the press-in hole enters the recess after passage of the biting portion and is deformed by the push-in portion while staying in the recess.

The portion of the inner wall that enters the recess includes a portion that bulges out by a restoring force of the resin after the passage of the biting portion, and a part of this bulged-out portion that is pushed into the recess while being forcibly deformed by the push of the push-in portion. Thus, a larger area of engagement of the inner wall with the biting portion can be ensured, thereby displaying a better function of locking the terminal fitting.

A portion of the inner wall of the press-in hole located immediately after the biting portion bulges out to enter the recess due to the restoring force of the resin. This bulged-out portion in the recess is engaged by the biting portion from behind with respect to the pressing direction, and displays a stopper function to prevent the terminal fitting from coming out. The portion of the inner wall that enters the recess includes a portion caused to bulge out after the passage of the biting portion due to the restoring force of the resin and also a portion that is pushed into the recess by the push-in portion. Thus, a larger area of engagement of the inner wall with the biting portion can be ensured, and the terminal fitting is locked more securely.

Most preferably, the biting portion preferably has a hole to reduce the stiffness of the biting portion.

These and other objects, features and advantages of the present invention will become more apparent upon reading of the following detailed description of preferred embodiments and accompanying drawings. It should be understood that even though embodiments are separately described, single features thereof may be combined to additional embodiments.

DETAILED DESCRIPTION OF THE PREFERRED EMBODIMENTS

Figure 1:
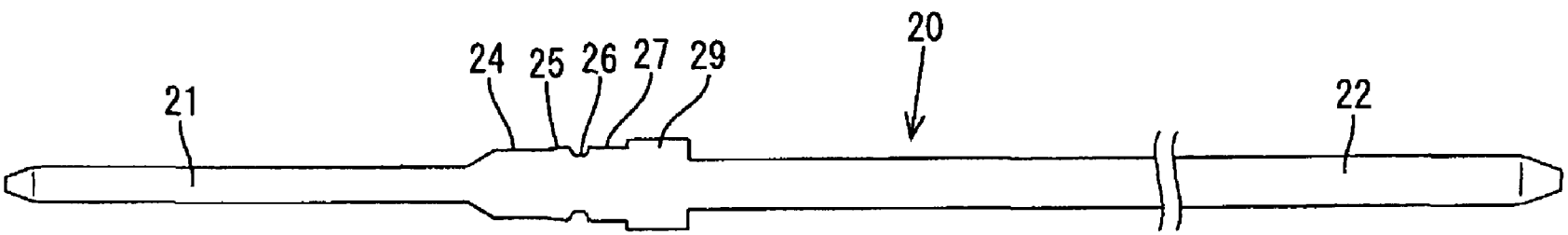
FIG. 1 is a plan view of a terminal fitting according to a first embodiment.
Figure 2:
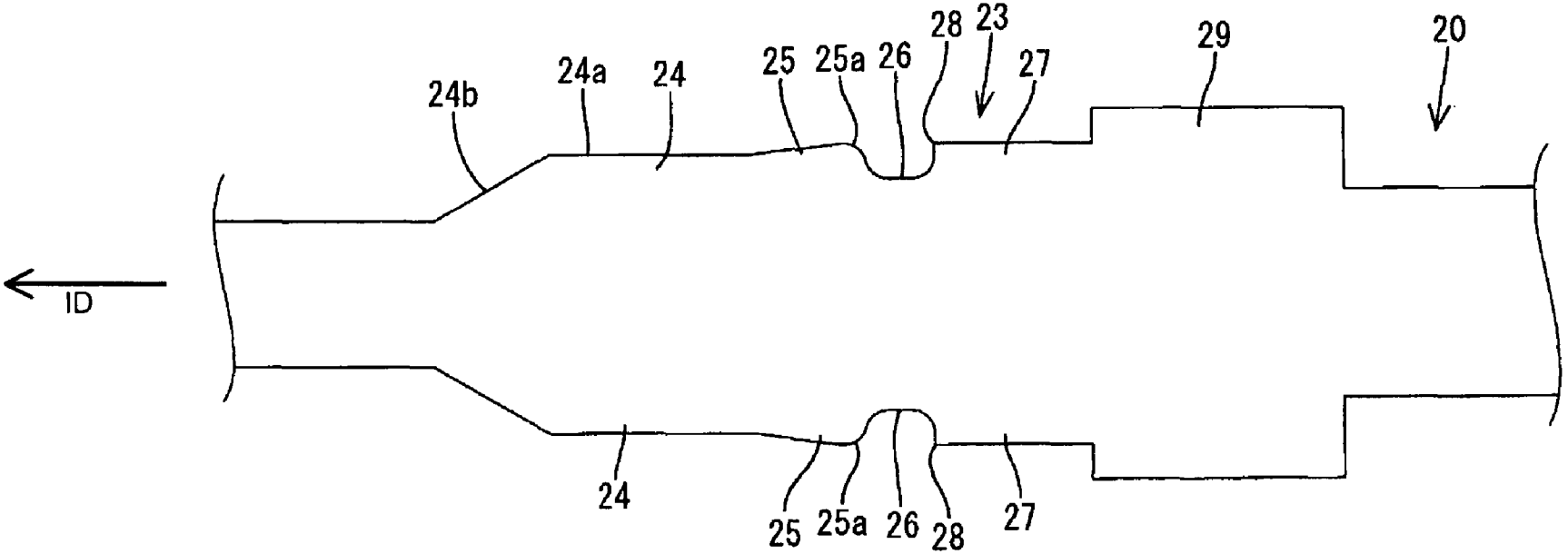
FIG. 2 is a partial enlarged plan view of the terminal fitting according to the first embodiment.
Figure 3:
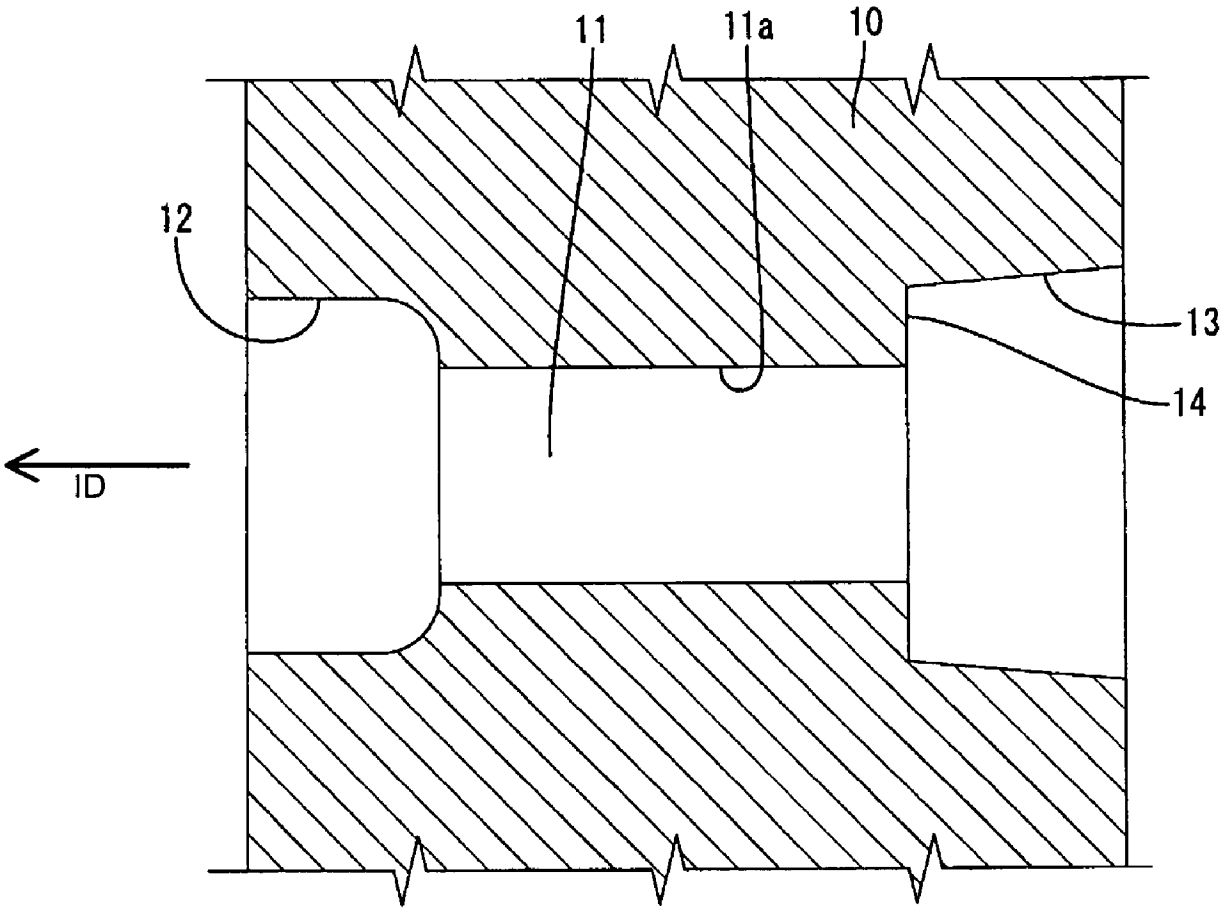
FIG. 3 is a partial section of a housing according to the first embodiment.
Figure 4:
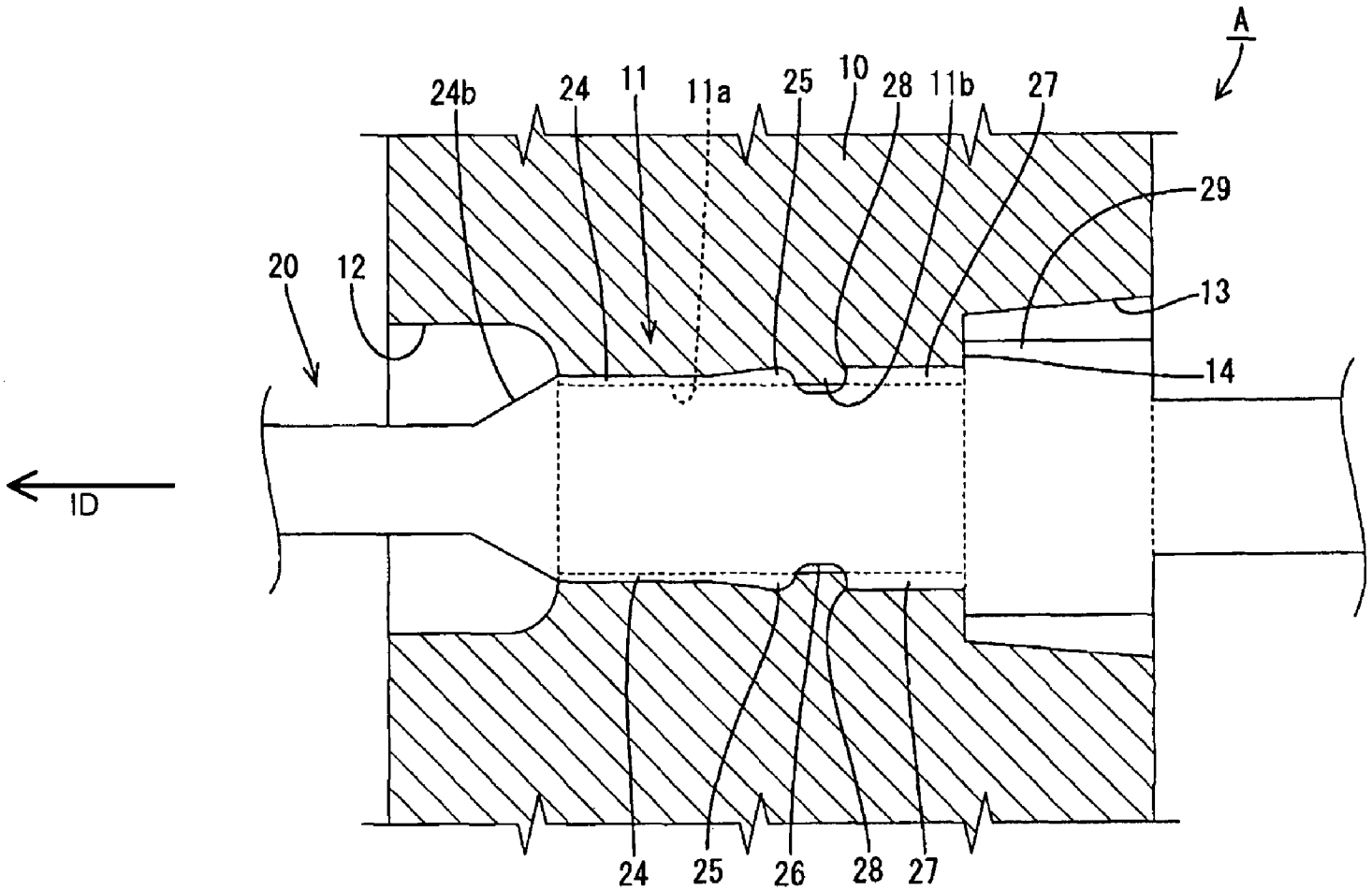
FIG. 4 is a partial enlarged section showing a state where the terminal fitting is pressed into a press-in hole in the first embodiment.
Figure 5:
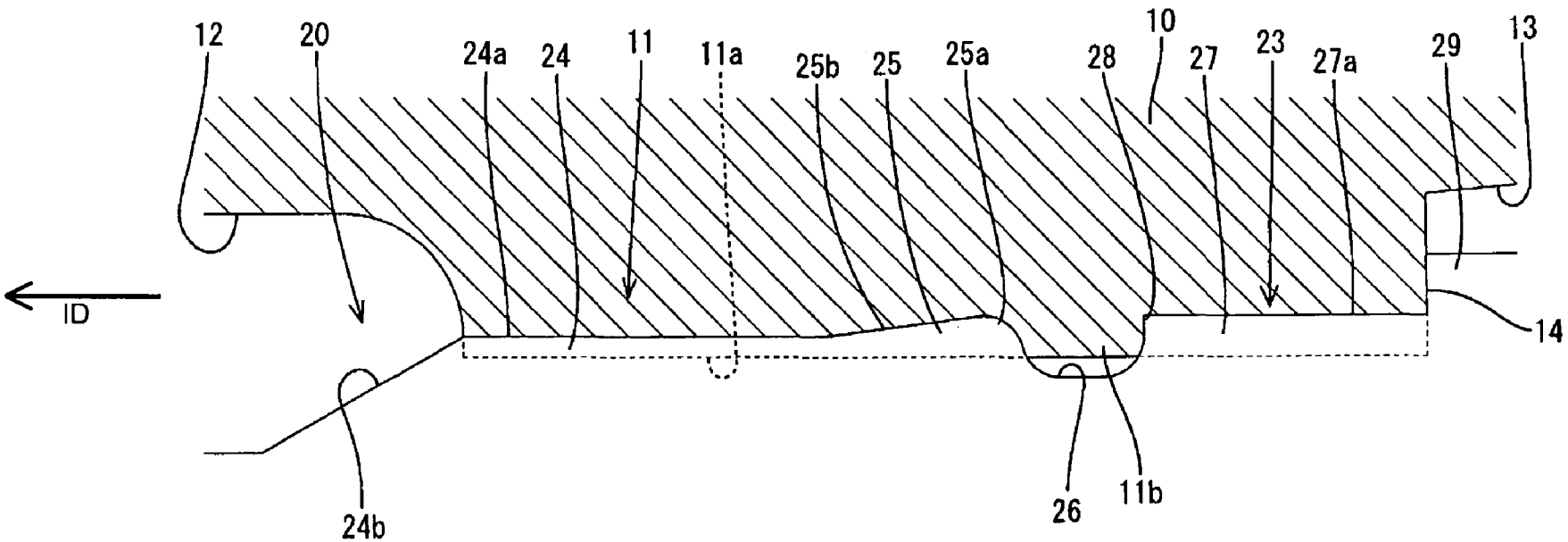
FIG. 5 is a partial enlarged section showing an inner wall of the press-in hole pressed by the terminal fitting in the first embodiment.

A connector according to a first embodiment of the invention is identified by the letter A in FIGS. 1 to 5. The connector A is used, for example, as a circuit board connector and has a press-in hole 11 that penetrates a housing made e.g. of a synthetic resin along an inserting direction ID. A terminal fitting 20 is to be pressed into the press-in hole 11. In the following description, the same direction as a pressing or insertion direction ID of the terminal fitting 20 into the press-in hole 11 is referred to as a forward direction and the opposite direction is referred to as a backward direction.

The press-in hole 11 has a substantially constant width (vertical dimension in FIG. 3), and left and right inner walls 11*a* (upper and lower walls in FIG. 3) are substantially flat and substantially parallel with the pressing direction ID. A recess 12 is formed in the front surface (left surface in FIG. 3) of the housing 10 and is filled, for example, by a potting or insulating material. On the other hand, an accommodating space 13 is formed in the rear surface of the housing 10, and a front-stop surface 14 is formed at the back end surface of the accommodating space 13.

The terminal fitting 20 is narrow and long substantially in parallel with the pressing direction ID and has a substantially symmetrical shape with respect to a width direction that is substantially normal to the pressing direction ID. A first connecting portion 21 is formed at the front-end of the terminal fitting 20 with respect to the pressing direction ID and is connectable with, for example, a mating terminal (not shown). A second connecting portion 22 is formed at the rear-end portion of the terminal fitting 20 and is connectable with, for example, a circuit board (not shown).

A press-in portion 23 wider than the connecting portions 21, 22 and to be forcibly pressed into the press-in hole 11 is formed in a longitudinal middle portion of the terminal fitting 20. A close-contact portion 24, a biting projection 25, a recess 26 and a push-in portion 27 are formed on each of the left and right edges of the press-in portion 23 in this order from the front side towards the back side along the pressing direction ID.

An outer edge 24*a* of each close-contact portion 24 is substantially straight and substantially parallel with the pressing direction ID of the terminal fitting 20. The width of the close-contact portion 24 as measured between the outer edges 24*a* is slightly wider than a spacing between the inner walls 11*a* of the press-in hole 11 before the terminal fitting 20 is pressed therein. The close-contact portion 24 has a length corresponding to about the front half of the press-in portion 23. A tapered portion 24*b* is formed substantially continuously at the front end of the close-contact portion 24 and is narrowed toward the first connecting portion 21.

The biting projections 25 are continuous with the rear ends of the close-contact portions 24, and the outer edges of the biting projections 25 extend substantially straight and obliquely out towards the back side at an angle less than about 25°, preferably about 10° to the pressing direction ID with respect to the outer edges of the close-contact portions 24. The biting projections 25 are substantially triangular and extend from the close-contact portion 24. Thus, an area of the press-in portion 23 widens gradually towards the back where the biting projections 25 are formed, and the biting projections 25 project farther in the widthwise direction than the close-contact portion 24. Accordingly, a biting amount of the biting projection 25 in the inner wall 11*a* of the press-in hole 11 is larger than a biting amount of the close-contact portion 24. A rounded portion 25*a* is formed at the rear of each biting projection 25.

The recesses 26 are hollows extending in towards a widthwise center of the terminal fitting 20 with respect to the biting projections 25, and a minimum width between the deepest parts of the recesses 26 is less than the spacing between the inner walls 11*a* of the press-in hole 11. The front inner edge of each recess 26 is substantially continuous with the rear edge of the arcuate portion 25*a* of the corresponding biting projection 25, and is substantially normal to the pressing direction ID.

An outer edge 27*a* of each push-in portion 27 is substantially straight and substantially parallel to the pressing direction ID of the terminal fitting 20, and the width of the press-in portion 23 at the push-in portions 27 is substantially equal to the maximum width of the biting projections 25 and larger than the spacing between the inner walls 11*a* of the press-in hole 11. Further, the length of the push-in portions 27 along forward and backward direction is shorter than the length of the close-contact portions 24. Pointed right angle edges 28 are formed at the front ends of the push-in portions 27 and are substantially continuous with the rear inner edges of the recesses 26.

A front-stop 29 is formed at the rear end of the press-in portion 23 and is wider than the area of the press-in portion 23 where the push-in portions 27 are formed. The front stop 29 has a front edge at a substantially right angle to the pressing direction ID. The front edge of the front-stop 29 contacts the front-stop surface 14 of the housing 10 when the terminal fitting 20 is pressed into the press-in hole 11 to a proper position, thereby preventing the terminal fitting 20 form being pressed into the press-in hole 11 any further.

The terminal fitting 20 is inserted in the inserting direction ID into the press-in hole 11 from the side of the first connecting portion 21. A resistance is created when the rear end of the tapered portion 24*b* contacts the entrance at the rear end of the press-in hole 11 and, thereafter, the terminal fitting 20 is pushed with a stronger force and pressed into the press-in hole 11.

The close-contact portions 24 deform and/or cut the inner walls 11*a* of the press-in hole 11 in the pressing process to forcibly widen the press-in hole. At this time, a sliding resistance between the close-contact portions 24 and the inner walls 11*a* of the press-in hole 11 is relatively small and substantially constant since the outer edges 24*a* of the close-contact portions 24 are substantially straight and substantially parallel with the pressing direction ID. Further, the inner walls 11*a* of the press-in hole 11 are substantially parallel with the inserting direction ID and widened amounts of the inner walls 11*a* caused by the terminal fitting 20 are held constant. Thus, the sliding resistance hardly varies.

The biting projections 25, the recesses 26 and the push-in portions 27 successively enter the press-in hole 11 after the close-contact portions 24 are pushed entirely into the press-in hole 11. The biting projections 25 project out more than the outer edges 24*a* of the close-contact portions 24. Thus, the biting projections 25 further widen the inner walls 11*a* beyond the widening caused by the close-contact portions 24. The outer edges 25*b* of the biting projections 25 are smoothly continuous with the outer edges 24*a* of the close-contact portions 24. Accordingly, the inner walls 11*a* are widened smoothly.

Portions of the inner walls 11*a* bulge back slightly immediately after passage of the biting projections 25 due to a resilient restoring force of the material (e.g. resin) of the housing 10 and enter the recesses 26 as restored inner wall portions 11*b*. Thus, the widening caused by the biting projections 25 is a temporary phenomenon. The edges 28 at the front ends of the push-in portions 27 contact the restored inner wall portions 11*b* from behind and push them forward. Thus, rear-ends of the restored inner wall portions 11*b* deform and displace forward in the inserting direction ID while staying in the recesses 26. Accordingly, the amount of the restored inner wall portions 11*b* entering the recesses 26 increases by the amount that the restored inner wall portions 11*b* are deformed by the push-in portions 27. When displacements of the restored inner wall portions 11*b* exceed a specified amount, they are partly scraped or cut by the corner edges 28 and the scraped portions are displaced in the recesses 26. Thus, the forces of the outer edges 27*a* of the push-in portions 27 pushing the inner walls 11*a* are reduced, thereby reducing frictional resistance between the push-in portions 27 and the inner walls 11.

The terminal fitting 20 is pressed to the proper position where the front-stop 29 substantially contacts the front-stop surface 14. Rear-ends of the restored inner wall portions 11*b* deformed by the edges 28 immediately before the terminal fitting 20 reaches the proper position stay in the recesses 26 without being scraped. Accordingly, large areas of engagement are ensured between the restored inner wall portions 11*b* in the recesses 26 and the biting projections 25 when an external force acts in withdrawing direction on the terminal fitting 20. Thus, the terminal fitting 20 is locked securely so as not to come out. Areas of the restored inner wall portions 11*b* scraped by the edges 28 remain at least partly stored in the recesses 26.

As described above, the terminal fitting 20 is prevented from coming out by the frictional resistance between the close-contact portions 24 and the inner walls 11*a* of the press-in hole 11 and by the biting of the biting projections 25 in the inner walls 11*a* of the press-in hole 11 even if a force acts in withdrawing direction on the terminal fitting 20.

The outer edges 24*a* of the close-contact portions 24 are substantially parallel with the inserting direction ID and are in sliding contact with the inner walls 11*a* of the press-in hole 11 at an initial stage of the pressing operation. Thus, resistance is small as compared to a case where projections bite in the inner walls 11*a* of the press-in hole 11. Further, the outer edges 27*a* of the push-in portions 27 also are substantially parallel with the inserting direction ID. Thus, resistance during the pressing operation is reduced further.

Portions of the inner walls 11*a* immediately after the biting projections 25 bulge back due to a resilient restoring force of the resin and enter the recesses 26 when the terminal fitting 20 is pressed to the proper position. These restored inner wall portions 11*b* in the recesses 26 exhibit a stopper function by engaging the biting projections 25 from behind when seen along the pressing direction ID. Thus, a function of preventing the terminal fitting 20 from coming out is more reliable.

The restored inner wall portions 11*b* that have entered the recesses 26 include the portions that bulged due to the restoring force of the resin after the passage of the biting projections 26 and portions that are pushed into the recesses 26 by the push-in portions 27. Thus, larger areas of engagement of the restored inner wall portions 11*b* with the biting projections 25 is ensured to display a better function of preventing the terminal fitting 20 from coming out.

Figure 6:
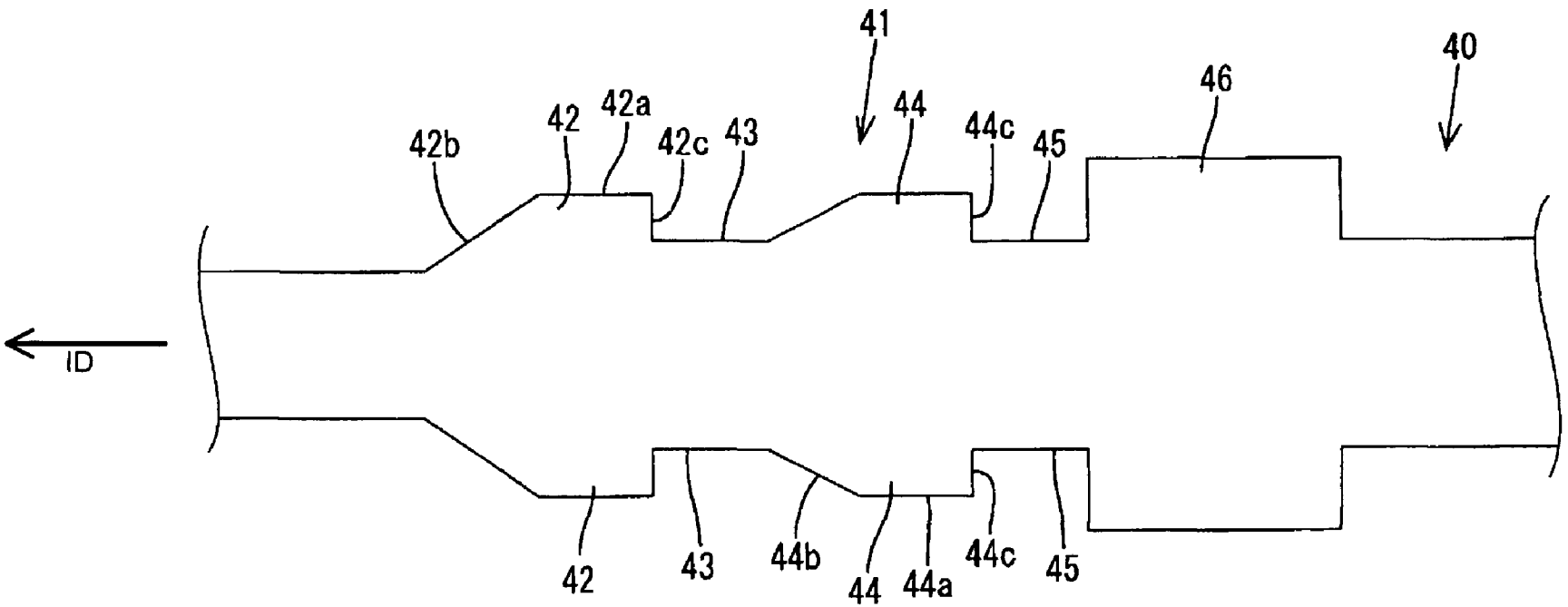
FIG. 6 is a partial enlarged plan view of a terminal fitting according to a second embodiment.
Figure 7:
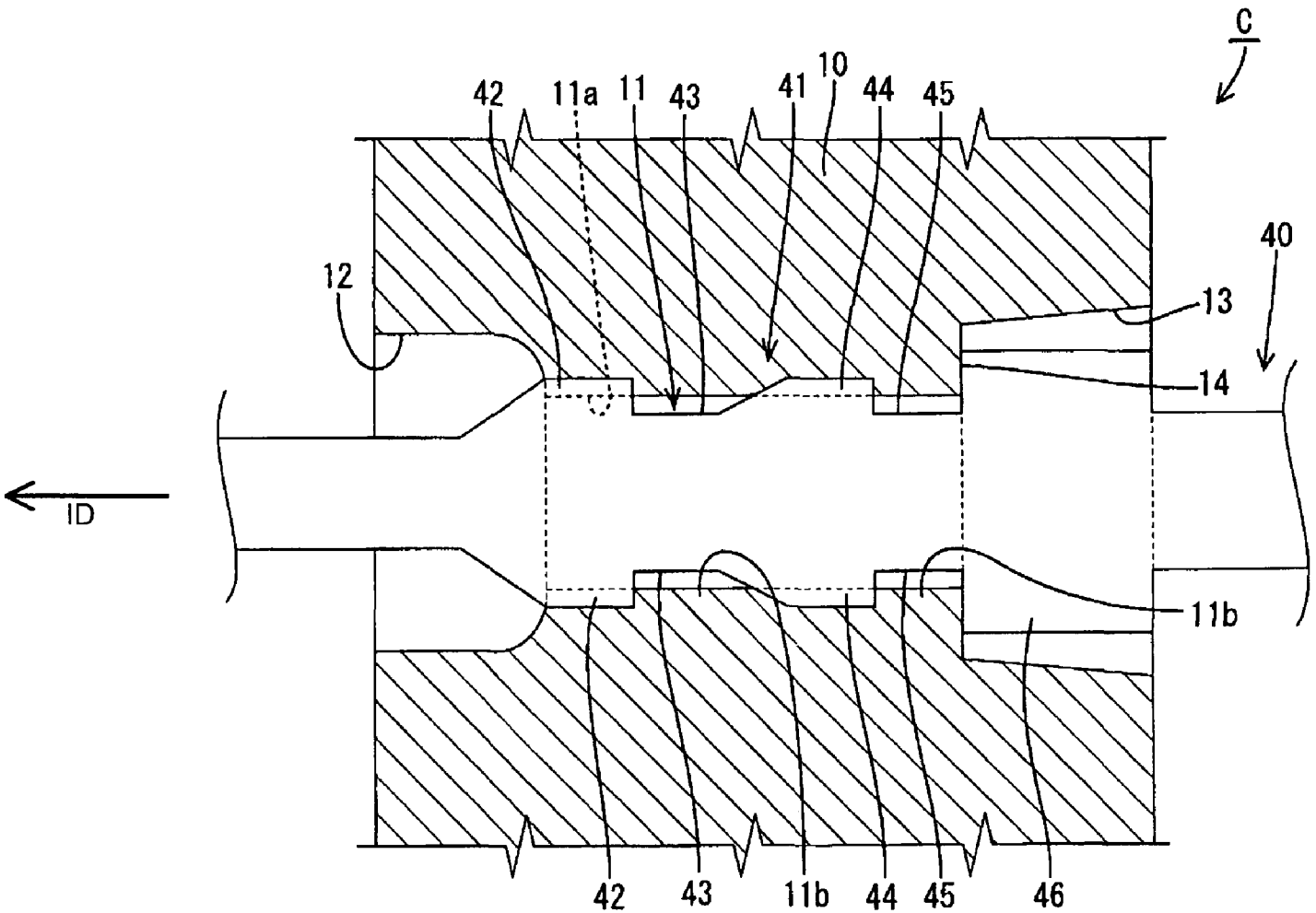
FIG. 7 is a partial enlarged section showing the inner wall of the press-in hole pressed by the terminal fitting in the second embodiment.

A second embodiment of the invention is described with reference to FIGS. 6 and 7. The second embodiment relates to a connector C that differs from the connector A of the first embodiment in the shape of the press-in portion 23 of the terminal fitting 20. Other construction is similar to or the same as the first embodiment. Structural elements of the second embodiment that are similar to or the same as the first embodiment are identified by the same reference numerals but are not described again.

A first biting projection 42, a first recess 43, a second biting projection 44 and a second recess 45 are formed on each of the left and right edges of a press-in portion 41 of a terminal fitting 40 of the second embodiment in this order from the front side toward the back side along an inserting direction ID.

Each first biting projection 42 has a substantially straight outer edge 42*a* substantially parallel with the inserting direction ID of the terminal fitting 40, a front edge 42*b* inclined to the inserting direction ID, and a rear edge 42*c* substantially at a right angle to the inserting direction ID. The width of the press-in portion 41 at the first biting projections 42 is slightly wider than the spacing between the inner walls 11*a* of the press-in hole 11.

The first recesses 43 are hollows extending in toward a widthwise center of the terminal fitting 40 with respect to the first biting projections 42, and a minimum width between the deepest parts of the first recesses 43 is less than the spacing between the inner walls 11*a* of the press-in hole 11. The front inner edge of each recess 43 is substantially continuous with the rear edge 42*c* of the corresponding first biting projection 42.

Each second biting projection 44 has a substantially straight outer edge 44*a* substantially parallel with the inserting direction ID of the terminal fitting 40, a front edge 44*b* inclined to the pressing direction ID and serving as the rear edge of the corresponding first recess 43, and a rear edge 44*c* substantially at a right angle to the inserting direction ID. The width of the press-in portion 41 at the second biting projections 44 (spacing between the outer edges 44*a*) is substantially equal to the width at the first biting projections 42.

The second recesses 45 are hollows extending in toward a widthwise center of the terminal fitting 40 with respect to the second biting projections 44, and a minimum width defined between the deepest parts of the second recesses 45 substantially equals the width at the first recesses 43. Front inner edges of the second recesses 45 are the rear edges 44*c* of the second biting projections 44 and the rear edges thereof are the front edge of a front-stop 46.

The first biting projections 42 advance in the press-in hole 11 and widen the inner walls 11*a* of the press-in hole 11 in the process of pressing the terminal fitting 40 in the inserting direction ID into the housing 10. At this time, a sliding resistance between the first biting projections 42 and the inner walls 11*a* of the press-in hole 11 is relatively small and substantially constant since the outer edges 42*a* of the first biting projections 42 are substantially parallel with the inserting direction ID. Further, the inner walls 11*a* of the press-in hole 11 are substantially parallel with the inserting direction ID and widening of the inner walls 11*a* caused by the terminal fitting 40 are held constant. Thus, the sliding resistance hardly varies.

The first recesses 43, the second biting projections 44 and the second recesses 45 successively enter the press-in hole 11 after the first biting projections 42 are entirely in the press-in hole 11. Portions of the inner walls 11*a* of the press-in hole 11 forcibly widened by the first biting projections 42 bulge back slightly towards the middle of the press-in hole 11 due to a resilient restoring force of the resin to enter the first recesses 43 immediately after the passage of the first biting projections 42. Thus, the widening by the first biting projections 42 is a temporary phenomenon. The restored inner wall portions 11*b* that entered the first recesses 43 are widened again by the second biting projections 44. The outer edges 44*a* of the second biting projections 44 also are substantially parallel with the inserting direction ID. Thus, a sliding resistance between the second biting projections 44 and the inner walls 11*a* of the press-in hole 11 is small. The portions of the inner walls 11*a* widened by the second biting portions 44 bulge back due to the resilient restoring force of the resin to enter the second recesses 45 immediately after the passage of the second biting projections 44. In other words, the widening caused by the second biting projections 44 also is a temporary phenomenon.

The terminal fitting 40 is pressed to a proper position where the front-stop 46 substantially contacts the front-stop surface 14. At this time, the terminal fitting 40 is locked securely so as not to come out due to the biting of the first and second biting projections 42, 44 in the inner walls 11*a* of the press-in hole 11 and the engagement of the restored inner wall portions 11*b* in the first and second recesses 43 and 45 even if an external force acts in withdrawing direction on the terminal fitting 40.

Figure 8:
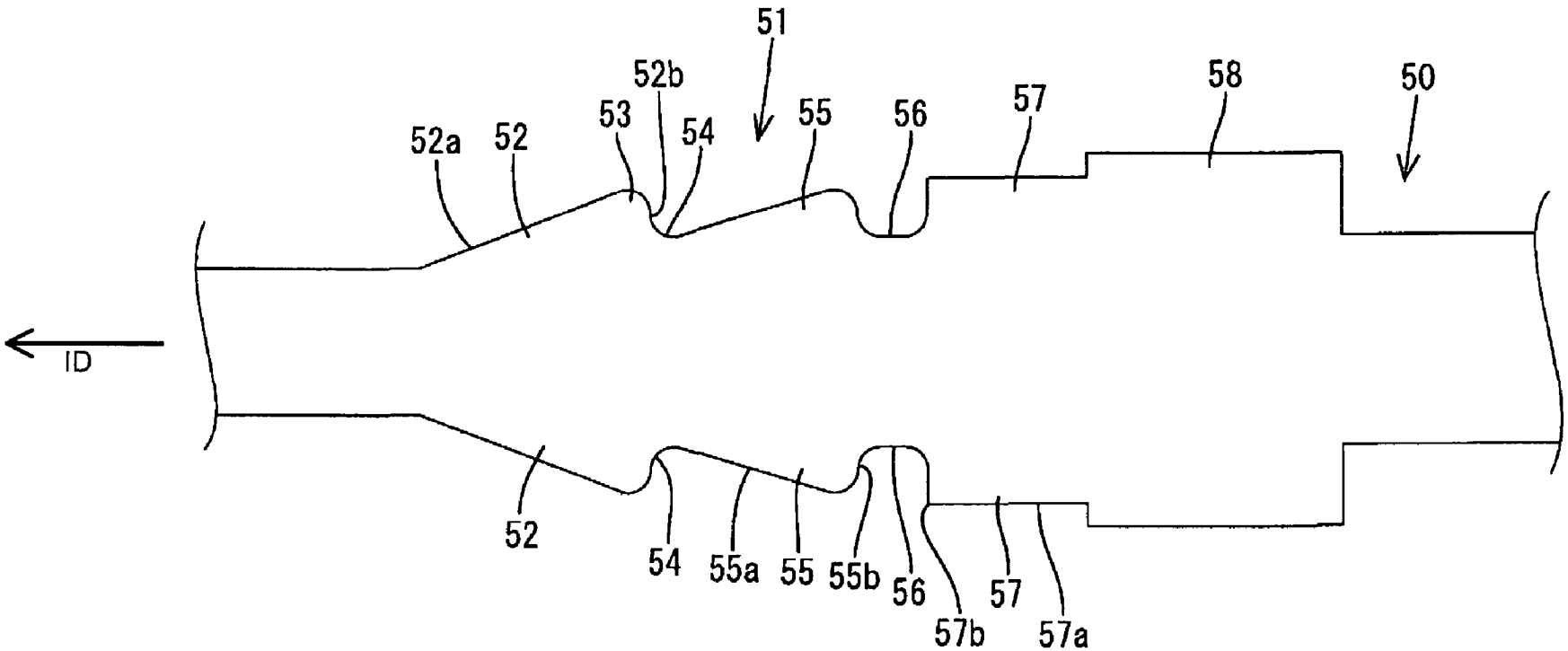
FIG. 8 is a partial enlarged plan view of a terminal fitting according to a third embodiment.
Figure 9:
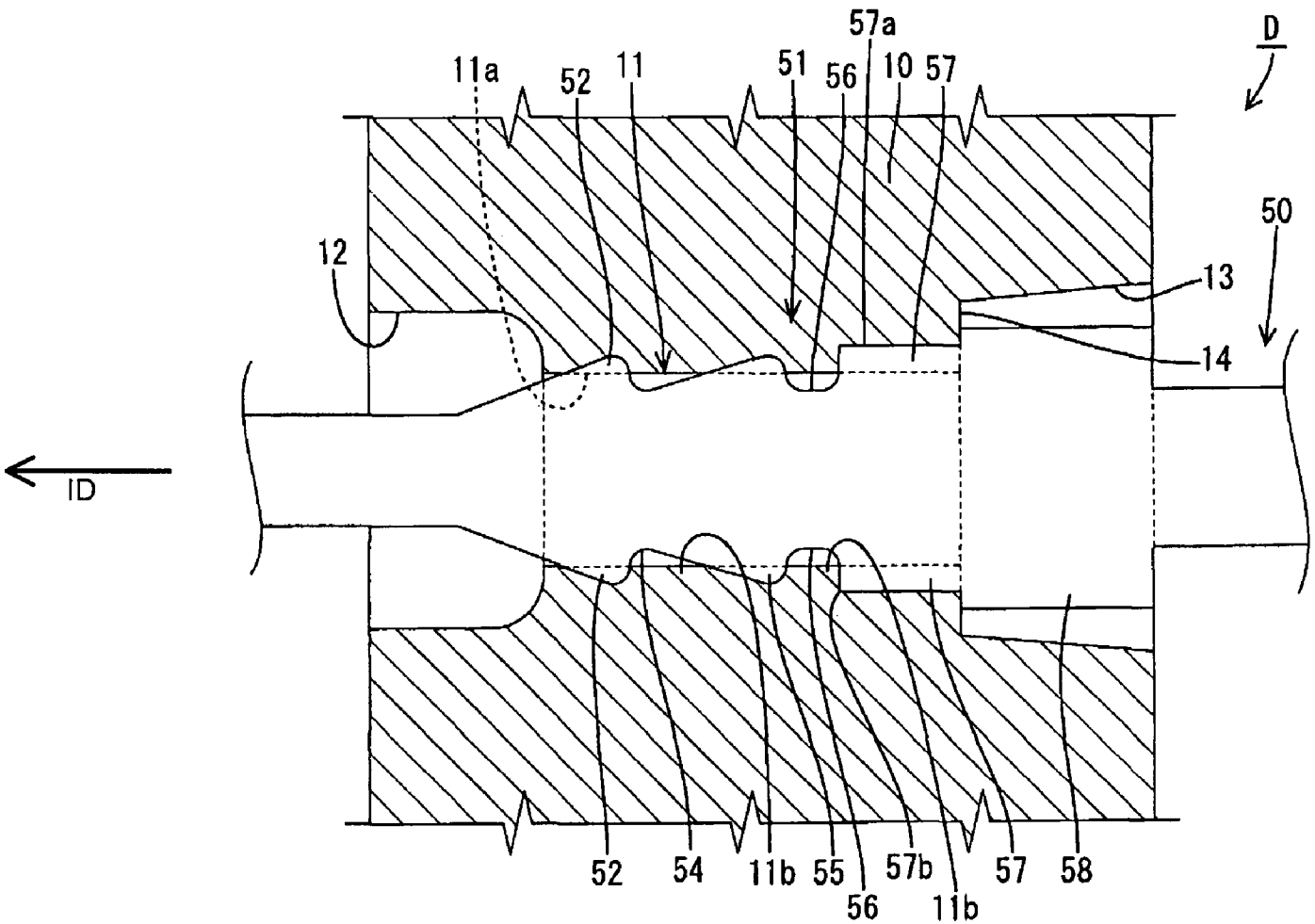
FIG. 9 is a partial enlarged section showing the inner wall of the press-in hole pressed by the terminal fitting in the third embodiment.

A third embodiment of the invention is described with reference to FIGS. 8 and 9. A connector D of the third embodiment differs from the connector A of the first embodiment in the shape of the press-in portion 23 of the terminal fitting 20. Other construction is similar to or the same as the first embodiment. Structural elements of the third embodiment that are similar to or the same as the first embodiment are identified by the same reference numerals but are not described again.

A first biting projection 52, a first recess 54, a second biting projection 55, a second recess 56 and a push-in portion 57 are formed on each of the left and right edges of a press-in portion 51 of a terminal fitting 50 of the third embodiment in this order from the front side toward the back side along an inserting direction ID.

Each first biting projection 52 has a substantially straight outer edge 52*a* extending out and back at an oblique angle of less than about 25°, preferably of about 10°, to the inserting direction ID. The first biting projection 52 is substantially triangular, and an area of the press-in projection 51 where the first biting projections 52 are formed is gradually widened toward the back. Further, the rear end of each first biting projection 52 defines an arcuate portion 53 extending in an arc from the outer edge 52*a* to a rear edge 52*b*.

The first recesses 54 are hollows extending in toward a widthwise center of the terminal fitting 50 with respect to the first biting projections 52, and a minimum width of the press-in portion 51 between the deepest parts of the first recesses 54 is less than the spacing between the inner walls 11*a* of the press-in hole 11. The front inner edge of each first recess 54 is substantially continuous with the rear edge 52*b* of the arcuate portion 53 of the corresponding biting projection 52.

The second biting projections 55 have substantially the same shape and dimensions as the first biting projections 52. Outer edges 55*a* of the second biting projections 55 are the rear edges of the first recesses 54.

The second recesses 56 are hollows extending in towards the widthwise center of the terminal fitting 50 with respect to the second biting projections 55, and a minimum width of the press-in portion 51 between the deepest parts of the second recesses 56 is substantially equal to that of the press-in portion 51 where the first recesses 54 are formed. The front inner edge of each second recess 56 is substantially continuous with a rear edge 55*b* of the corresponding second biting projection 55.

An outer edge 57*a* of each push-in portion 57 is substantially straight and parallel with the inserting direction ID of the terminal fitting 50. The width at the push-in portions 57 (spacing between the outer edges 57*a* of the left and right push-in portions 57) substantially equals the maximum width at the biting projections 52, 55, and hence exceeds the spacing between the inner walls 11*a* of the press-in hole 11. Substantially right-angled edges 57*b* are formed at the fronts of the push-in portions 57. The fronts of the right angle edges 57*b* are at substantially right angles to the inserting direction ID and are substantially continuous with the rear inner edges of the second recesses 56. A front-stop 58 is substantially continuous with the rear ends of the push-in portions 57.

The first biting projections 52 advance in the press-in hole 11 and deform, cut and forcibly widen the inner walls 11*a* of the press-in hole 11 in the process of at pressing the terminal fitting 50 in the inserting direction ID into the housing 10. The first recesses 54, the second biting projections 55, the second recesses 56 and the push-in portions 57 successively enter the press-in hole 11 after the first biting projections 52 are pushed entirely into the press-in hole 11. Portions of the inner walls 11*a* of the press-in hole 11 forcibly widened by the first biting portions 52 bulge back slightly towards the middle of the press-in hole 11 due to a resilient restoring force of a material (e.g. resin) to enter the first recesses 54 immediately after the passage of the first biting projections 52. In other words, the widening caused by the first biting projections 52 is temporary. The restored inner wall portions 11*b* that enter the first recesses 54 are deformed and forcibly widened again by the second biting projections 55. Portions of the inner walls 11*a* forcibly widened by the second biting projections 55 bulge back due to the resilient restoring force of the resin to enter the second recesses 56 immediately after the passage of the second biting projections 55. Thus, the widening caused by the second biting portions 55 also is temporary.

Edges 57*b* at the front ends of the push-in portions 57 contact the restored inner wall portions 11*b* from behind as seen in the pushing direction ID to push them forward. Thus, rear-ends of the restored inner wall portions 11*b* are deformed and displaced forward while staying in the recesses 56, and amounts of the restored inner wall portions 11*b* entering the recesses 56 increase by as much as the restored inner wall portions 11*b* are deformed by the push-in portions 57. Displacements of the restored inner wall portions 11*b* that exceed a specified amount are scraped or cut by the corners of the edges 57*b* and the scraped or cut portions enter the second recesses 56. Since the restored inner wall portions 11*b* are scraped or cut by the edges 57*b*, the forces of the outer edges 57*a* of the push-in portions 57 pushing the inner walls 11*a* are reduced, thereby reducing a frictional resistance between the push-in portions 57 and the inner walls 11.

The terminal fitting 50 is pressed to a proper position where the front-stop 58 contacts the front-stop surface 14.

The rear-ends of the restored inner wall portions 11*b* deformed by the edges 58 immediately before the terminal fitting 50 reaches the proper position stay in the second recesses 56 without being scraped. Accordingly, large areas of engagement can be ensured between the restored inner wall portions 11*b* in the second recesses 56 and the second biting projections 55 when an external force acts in withdrawing direction on the terminal fitting 50. The portions of the restored inner wall portions 11*b* escaped by the edges 57*b* remain in the second recesses 56.

As described above, the terminal fitting 50 is locked securely by the biting of the first and second biting projections 52, 55 in the inner walls 11*a* of the press-in hole 11 and the engagement of the restored inner wall portions 11*b* in the first and second recesses 54 and 56 even if a force of withdrawing direction acts on the terminal fitting 50.

Figure 10:
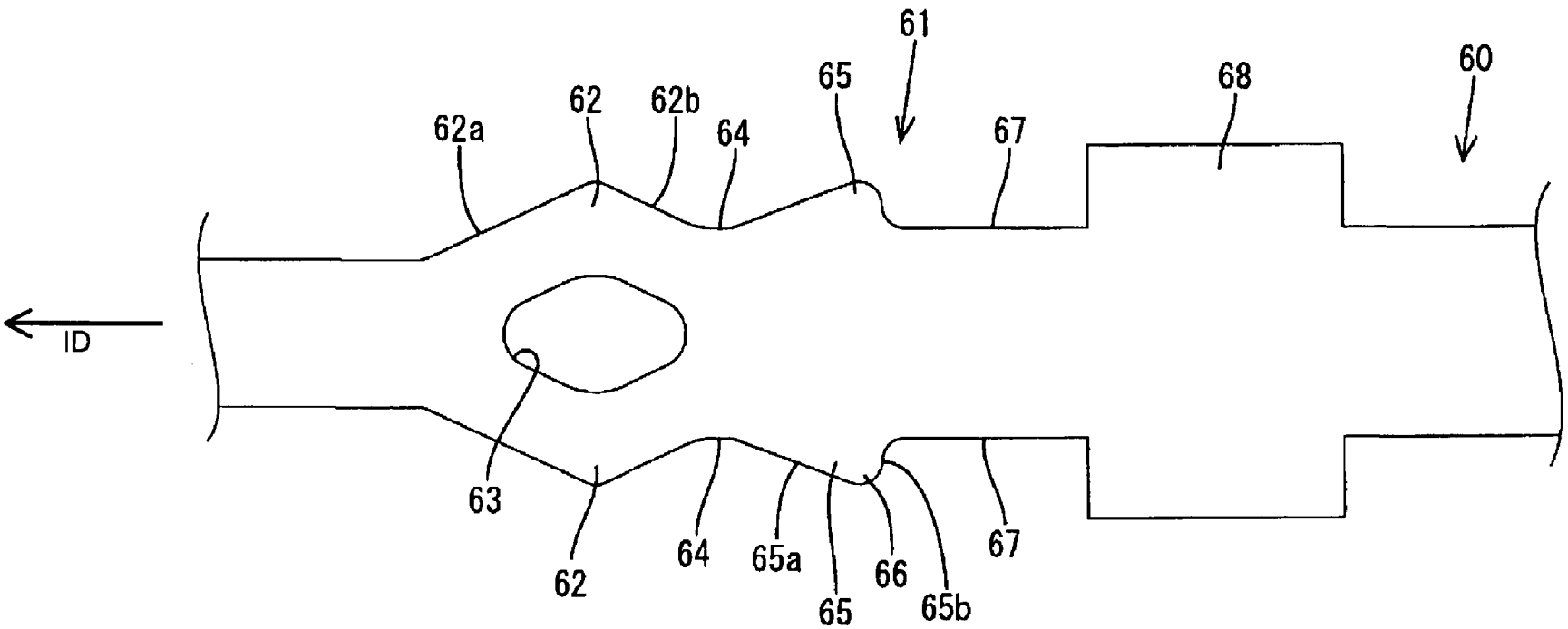
FIG. 10 is a partial enlarged plan view of a terminal fitting according to a fourth embodiment.
Figure 11:
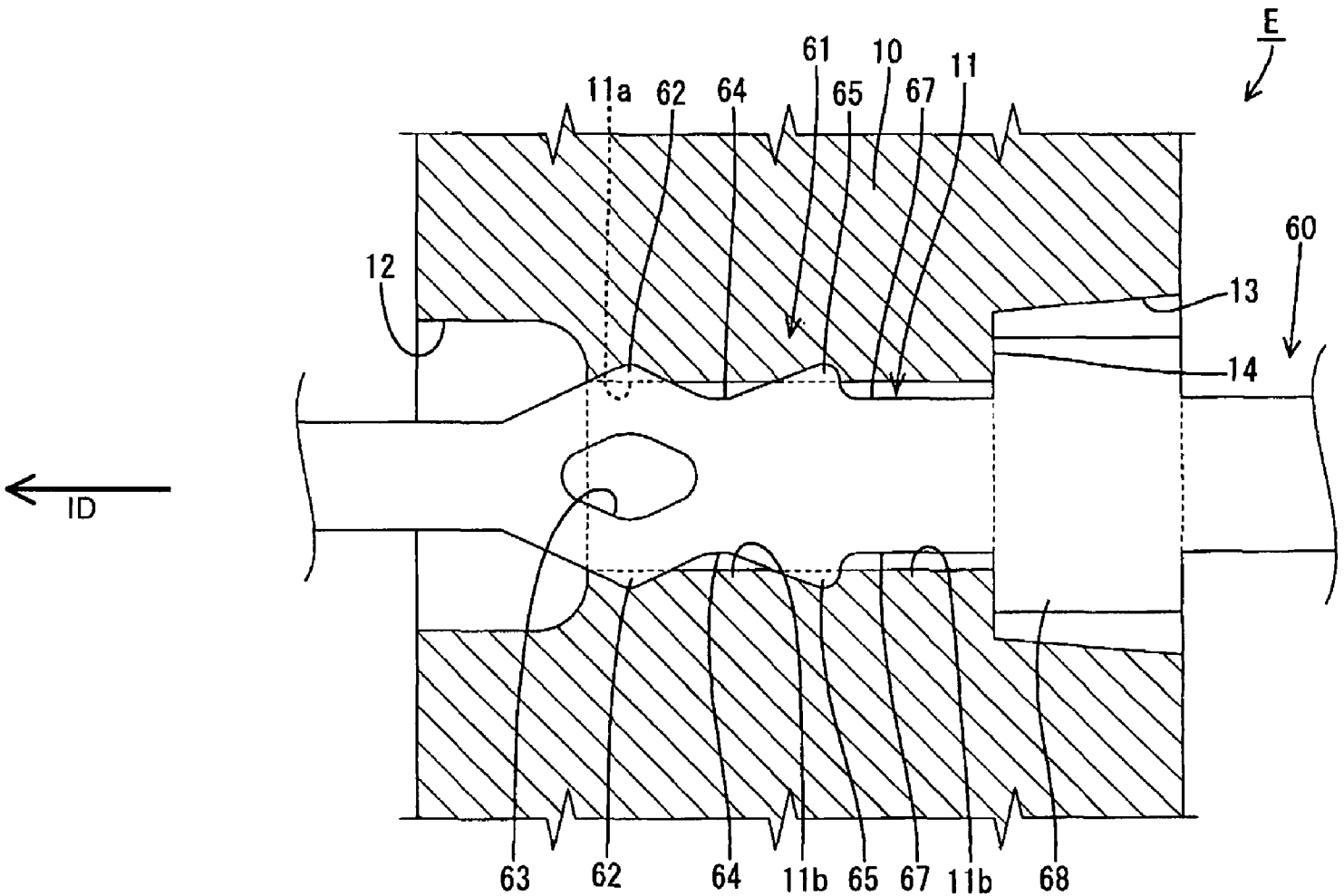
FIG. 11 is a partial enlarged section showing the inner wall of the press-in hole is pressed by the terminal fitting in the fourth embodiment.
Figure 12:
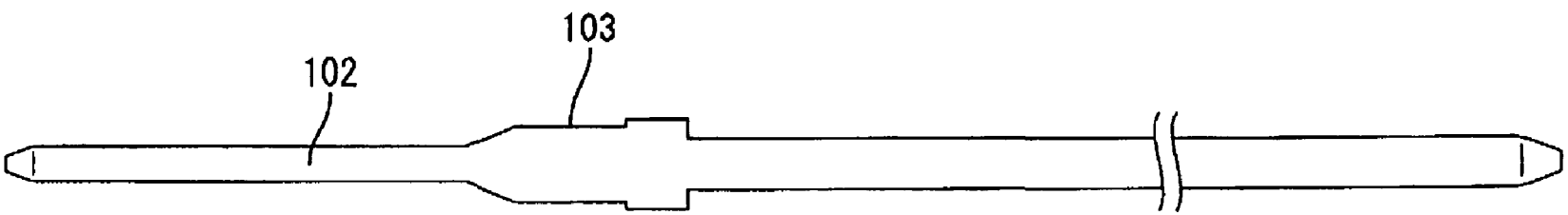
FIG. 12 PRIOR ART
FIG. 12 is a plan view of a prior art terminal fitting.
Figure 13:
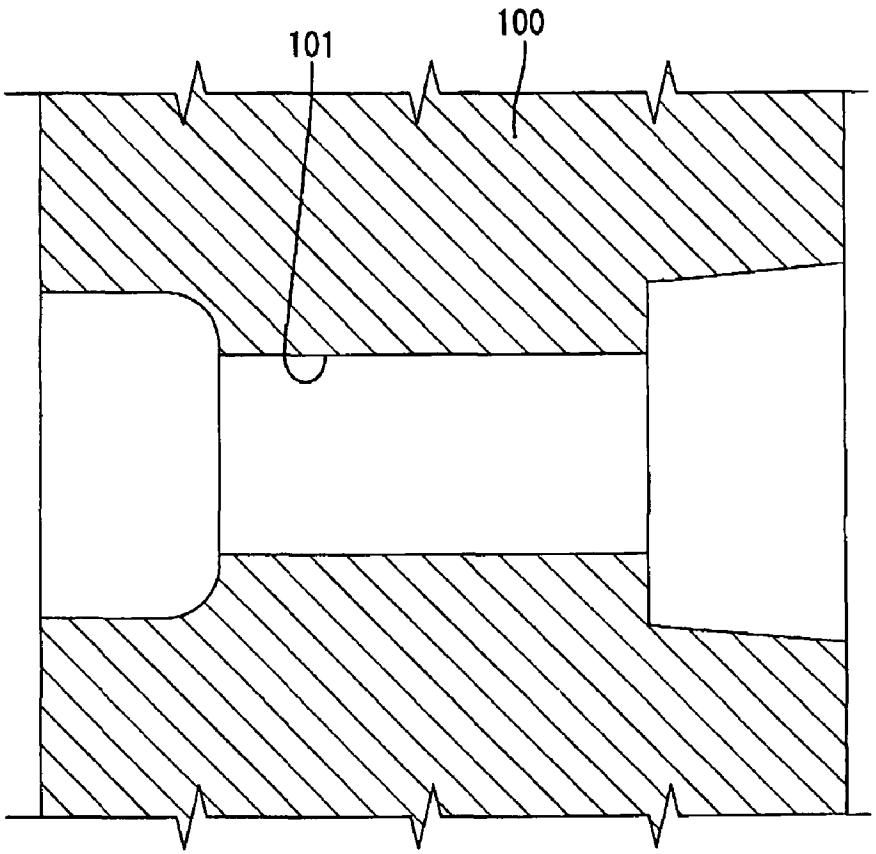
FIG. 13 PRIOR ART
FIG. 13 is a section of a prior art housing.
Figure 14:
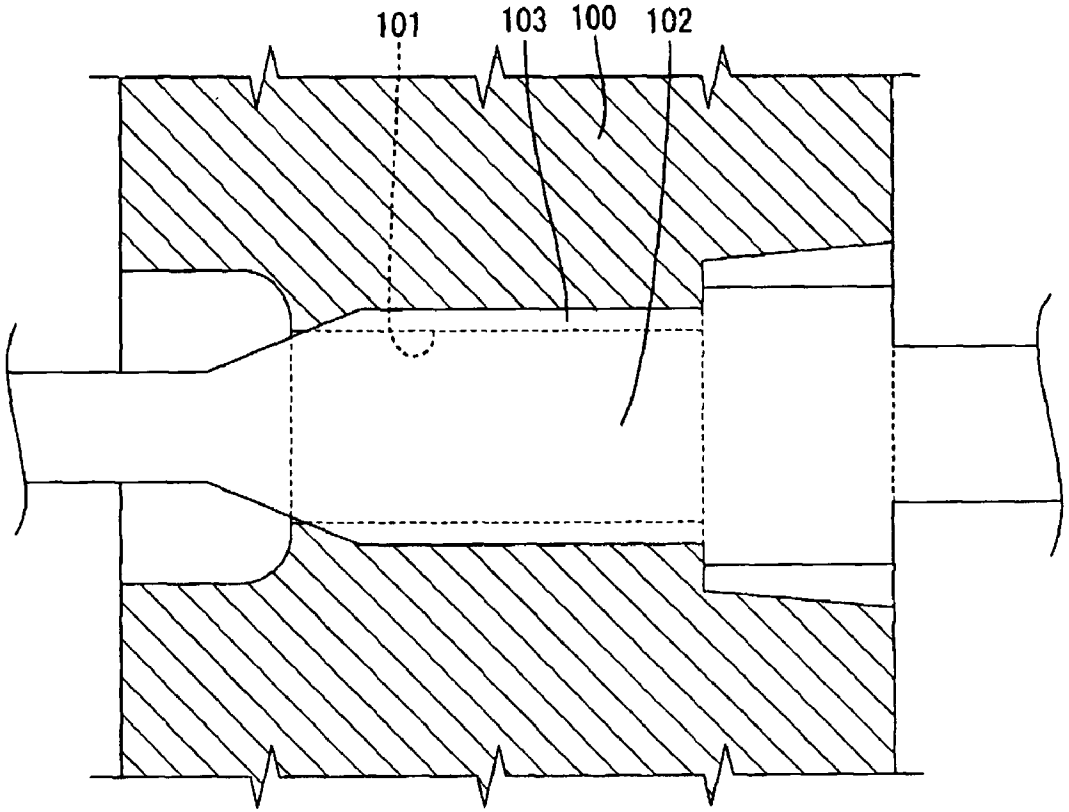
FIG. 14 PRIOR ART
FIG. 14 is a partial enlarged section showing a state where the terminal fitting is pressed into a press-in hole in the prior art.

A fourth embodiment of the invention is described with reference to FIGS. 10 and 11. A connector E of the fourth embodiment differs from the connector A of the first embodiment in the shape of the press-in portion 23 of the terminal fitting 20. Other construction is similar to or the same as the first embodiment. Structural elements of the fourth embodiment that are similar to or the same as the first embodiment are identified by the same reference numerals but are not described again.

A first biting projection 62, a first recess 64, a second biting projection 65 and a second recess 67 are formed on each of the left and right edges of a press-in portion 61 of a terminal fitting 60 of the fourth embodiment in this order from the front side toward the back side along an inserting direction ID.

Each first biting projection 62 has a substantially straight front outer edge 62*a* extending obliquely out and back at an angle of less than about 45°, most preferably of about 30°, to the inserting direction ID, and a substantially straight rear outer edge 62*b* extending obliquely in and back at a small angle of less than about 45°, most preferably of about 30°, to the pressing direction ID. The first biting projection 62 is substantially triangular. Thus, front halves of the first biting projections 62 gradually widened toward the back, whereas rear halves of the first biting projections 62 gradually narrow toward the back.

A window hole 63 penetrates a widthwise middle of the press-in portion 61 at an area where the first biting projections 62 are formed. Thus, the area of the press-in portion 61 where the first biting projections 62 are formed can undergo a resilient deformation to narrow the width thereof.

The first recesses 64 are hollows extending in toward a widthwise center of the terminal fitting 60 with respect to the first biting portions 62, and a minimum width in an area of the press-in portion 61 between the deepest parts of the first recesses 64 is smaller than the spacing between the inner walls 11*a* of the press-in hole 11. The front inner edge of each first recess 64 is substantially continuous with a rear edge 62*b* of the corresponding biting projection 62.

Each second biting projection 65 has a substantially straight outer edge 65*a* extending obliquely out and back at an angle of less than about 45°, most preferably of about 30°, to the pressing direction ID. Each second biting projection 65 is substantially triangular, and an area of the press-in portion 61 where the second biting projections 65 are formed gradually widens towards the back. Further, a rounded portion 66 is formed at the rear end of each second biting projection 65 and extends substantially in an arc from the outer edge 65*a* to a rear edge 65*b*.

The second recesses 67 are hollows extending in towards the widthwise center of the terminal fitting 60 with respect to the second biting projections 65, and a minimum width in an area of the press-in portion 61 between the deepest parts of the second recesses 67 substantially equals the width at the first recesses 64. The front inner edge of each second recess 67 is substantially continuous with the rear edge 65*b* of the arcuate portion 66 of the corresponding second biting projection 65. The rear edges of the second recesses 67 also are the front edges of a front-stop 68.

The first biting projections 62 advance in sliding contact with the inner walls 11*a* of the press-in hole 11 in the process of pressing the terminal fitting 60 in the inserting direction ID into the housing 10, and are deformed resiliently to be narrower. At this time, the inner walls 11*a* of the press-in hole 11 are hardly deformed as a force needed for deforming the first biting projections 62 inwardly is substantially smaller than the force needed to deform the inner walls 11*a* of the press-in hole 11. Thus, a sliding resistance between the first biting projections 62 and the inner walls 11*a* of the press-in hole 11 is small.

The first recesses 64, the second biting projections 65 and the second recesses 67 successively enter the press-in hole 11 after the first biting projections 62 are pushed into the press-in hole 11. Thus, the second biting projections 65 deform the inner walls 11*a* to widen the press-in hole 11. These forcibly widened portions bulge back slightly due to a resilient restoring force of a material (e.g. resin) to enter the second recesses 67 immediately after the passage of the second biting portions 65. In other words, the widening caused by the second biting projections 65 is temporary.

The terminal fitting 60 is pressed to a substantially proper position where the front-stop 68 contacts the front-stop surface 14. At this point, the terminal fitting 60 is locked so as not to come out by the biting of the second biting projections 65 in the inner walls 11*a* of the press-in hole 11 and the engagement of the restored inner walls 11*b* in the second recesses 67 even if an external force acts in withdrawing direction on the terminal fitting 60.

The invention is not limited to the above described and illustrated embodiments. For example, the following embodiments are also embraced by the technical scope of the present invention as defined by the claims. Beside the following embodiments, various changes can be made without departing from the scope and spirit of the present invention as defined by the claims.

The projecting distance of the push-in portions from the straight close-contact portions along widthwise direction and that of the biting projections from the close contact portions along widthwise direction are equal in the first embodiment. However, the former projecting distance may be shorter than the latter or vice versa according to the present invention.

The push-in portions may not be formed in the first embodiment.

No recess may be formed in the first embodiment.

The biting projections may overhang backward or be undercut with respect to the inserting direction ID.

A plurality of pairs of biting projections may be formed in the first embodiment.

The terminal fittings of the second and fourth embodiments may be formed with push-in portions as in the first embodiment.

One, three or more biting projections may be formed in the second and third embodiments.

The terminal fittings of the second, third and fourth embodiments may have substantially straight close-contact portions as in the first embodiment.

Although a distance between the widthwise center of the terminal fitting and the push-in portions exceeds the distance between the widthwise center of the terminal fitting and the biting projections in the third embodiment, the former distance may be smaller than or equal to the latter distance.

The terminal fittings of the first to third embodiments may be formed with a deformation permitting hole as in the fourth embodiment.

The terminal fittings are symmetrical with respect to widthwise direction in the first to fourth embodiments, but they may be asymmetrical.

What is claimed is:

1. A connector comprising:

a housing with opposite front and rear ends, an accommodating space extending into the rear end, a housing recess extending into the front end and a press-in hole extending between the accommodating space and the housing recess, the press-in hole defining a width measured transverse to a front to rear direction that is smaller than corresponding width dimensions of the accommodating space and the housing recess, a stop surface being formed in the accommodating space at locations surrounding the press-in hole, the stop surface being substantially normal to the front-to-rear direction, the stop surface being spaced by a selected distance from the housing recess; and a terminal fitting having a front connecting portion, a front biting projection unitary with a rear end of the front connecting portion and having substantially parallel outer side edges extending in front to rear directions and defining a width greater than the width of the press-in hole, each of the outside side edges of the front biting projection having a front tapered front edge extended toward the front connection portion, a front recess narrower than the front biting projection and continuous with a rear end of the front biting projection, a rear biting projection rearward of and adjacent to the front recess, the rear biting projection having substantially parallel outer side edges extending in front to rear directions and defining a width substantially equal to the width of the front biting projection, each of the outside side edges of the rear biting projection having a rear tapered front edge extended toward the front biting projection, the front and rear biting projections being configured to bite in the inner wall of the press-in hole as the terminal fitting is pressed therein, a rear recess narrower than the rear biting projection and continuous with a rear end of the rear biting projection, a stop having front edges at a rear end of the rear recess and aligned substantially normal to the substantially parallel outer side edges of the rear biting projection, the stop defining a width greater than the width of the press-in hole and greater than the widths of the front and rear biting projections, the front edges of the stop being spaced from a front end of the front biting projections by a distance substantially equal to the selected distance between the stop surface and the housing recess, a rear connecting portion rearward of and continuous with the stop, the front connecting portion, the front biting projection, the front recess, the rear biting projection, the rear recess, the stop and at least portions of the rear connecting portion being substantially symmetrical about a linear axis of the terminal fitting, wherein a portion of the inner wall of the press-in hole enters the front and rear recesses after the passage of the front and rear biting projections for resisting rearward forces exerted on the front connecting portion.

2. The connector of claim 1, wherein the housing is made of synthetic resin.

3. The connector of claim 2, wherein the outer side edges of the rear biting projection substantially align with the outer side edges of the front biting projection.

4. The connector of claim 3, further comprising an insulating material in the recess.

* * * * *